US007619593B2

(12) United States Patent
Fish et al.

(10) Patent No.: US 7,619,593 B2
(45) Date of Patent: Nov. 17, 2009

(54) ACTIVE MATRIX DISPLAY DEVICE

(75) Inventors: David A. Fish, Haywards Heath (GB); Jason R. Hector, Redhill (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 490 days.

(21) Appl. No.: 10/550,876

(22) PCT Filed: Mar. 16, 2004

(86) PCT No.: PCT/IB2004/000869

§ 371 (c)(1),
(2), (4) Date: Sep. 27, 2005

(87) PCT Pub. No.: WO2004/088624

PCT Pub. Date: Oct. 14, 2004

(65) Prior Publication Data

US 2006/0244687 A1 Nov. 2, 2006

(30) Foreign Application Priority Data

Mar. 29, 2003 (GB) ..... 0307320.2

(51) Int. Cl.
*G09G 3/30* (2006.01)
*G09G 3/12* (2006.01)

(52) U.S. Cl. ..... 345/76; 345/82; 345/204; 315/169.3

(58) Field of Classification Search ..... 345/55, 345/76, 80, 82, 204, 205, 211, 212, 214; 315/167, 169.1, 169.3; 313/498, 505
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,535,185 | B2 * | 3/2003 | Kim et al. | 345/76 |
| 6,919,868 | B2 * | 7/2005 | Tam | 345/76 |
| 7,221,342 | B2 * | 5/2007 | Fish | 345/80 |
| 2002/0021293 | A1 * | 2/2002 | Tam | 345/204 |
| 2002/0075252 | A1 * | 6/2002 | Lee | 345/211 |
| 2002/0195967 | A1 | 12/2002 | Kim et al. | |
| 2003/0011584 | A1 | 1/2003 | Azami et al. | |
| 2006/0077134 | A1 * | 4/2006 | Hector et al. | 345/76 |

(Continued)

FOREIGN PATENT DOCUMENTS

EP 0717446 A2 6/1996

(Continued)

OTHER PUBLICATIONS

He et al: "Current -Source-A-SI: H Thin-Film Transistor Circuit for Active-Matrix Organic Light-Emitting Displays"; IEEE Electron Device Letters, IEEE Inc., vol. 21, No. 12, December 2000, pp. 590-592, XP000975801.

(Continued)

*Primary Examiner*—My-Chau T Tran

(57) ABSTRACT

An addressing scheme is provided for a display having an array of current driven pixels. An input voltage is used for generating a desired source-drain current using a transistor operated with low duty cycle. This source-drain current is then passed through a drive transistor and the resulting gate-source voltage is stored on a capacitor for subsequent driving of the display element.

13 Claims, 6 Drawing Sheets

U.S. PATENT DOCUMENTS

2006/0208979 A1* 9/2006 Fish et al. ..... 345/81

FOREIGN PATENT DOCUMENTS

EP 1130565 A1 9/2001
WO WO9636959 A2 11/1996
WO WO9848403 A1 10/1998

OTHER PUBLICATIONS

International Search Report for Application No. PCT/IB2004/000869 Contained in Publication No. W02004088624.
Written Opinion of the International Searching Authority for International Application No. PCT/IB2004/000869.

* cited by examiner

ACTIVE MATRIX DISPLAY DEVICE

This invention relates to active matrix display devices, particularly active matrix electroluminescent display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-driven display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice, there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

FIG. 2 shows in simplified schematic form a known pixel and drive circuitry arrangement for providing voltage-programmed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended. The drive transistor 22 draws a current from the power supply line 26.

The drive transistor 22 in this circuit is implemented as a p-type TFT, so that the storage capacitor 24 holds the gate-source voltage fixed. This results in a fixed source-drain current through the transistor, which therefore provides the desired current source operation of the pixel.

In the above basic pixel circuit, for circuits based on polysilicon, there are variations in the threshold voltage of the transistors due to the statistical distribution of the polysilicon grains in the channel of the transistors. Polysilicon transistors are, however, fairly stable under current and voltage stress, so that the threshold voltages remain substantially constant.

The variation in threshold voltage is small in amorphous silicon transistors, at least over short ranges over the substrate, but the threshold voltage is very sensitive to voltage stress. Application of the high voltages above threshold needed for the drive transistor causes large changes in threshold voltage, which changes are dependent on the information content of the displayed image. There will therefore be a large difference in the threshold voltage of an amorphous silicon transistor that is always on compared with one that is not. This differential ageing is a serious problem in LED displays driven with amorphous silicon transistors.

In addition to variations in transistor characteristics there is also differential ageing in the LED itself. This is due to a reduction in the efficiency of the light emitting material after current stressing. In most cases, the more current and charge passed through an LED, the lower the efficiency.

It has been recognised that a current-addressed pixel (rather than a voltage-addressed pixel) can reduce or eliminate the effect of transistor variations across the substrate. For example, a current-addressed pixel can use a current mirror to sample the gate-source voltage on a sampling transistor through which the desired pixel drive current is driven. The sampled gate-source voltage is used to address the drive transistor. This partly mitigates the problem of uniformity of devices, as the sampling transistor and drive transistor are adjacent each other over the substrate and can be more accurately matched to each other. Another current sampling circuit uses the same transistor for the sampling and driving, so that no transistor matching is required, although additional transistors and address lines are required. The addressing circuitry (row and column driver circuits) for current-addressing of a display is, however, more complicated, and long pixel programming times may be required as a result of the high column capacitance.

According to the invention, there is provided an active matrix display device comprising an array of display pixels, each pixel comprising:

a current driven light emitting display element and a first drive transistor for driving a current through the display element, the display element and the first drive transistor being in series between power supply lines;

a first storage capacitor for storing a gate-source voltage of the first drive transistor; and a second drive transistor for providing a drive current based on an input voltage provided to the gate of the second drive transistor.

In this arrangement, the pixels are voltage addressed, as a voltage is provided for application to the gate of the second drive transistor. This second drive transistor only needs to be driven for long enough that the correct voltage is stored on the first storage capacitor, for the subsequent driving of the display element. Thus, the second drive transistor can be operated with low duty cycle, so that the effects of ageing are minimised. In this way, the current output characteristics remain stable, and the gate-source voltage for the first drive transistor, which does suffer from ageing, is obtained by sampling the desired current. This therefore compensates for any change in threshold voltage.

In this description and claims the term "power supply line" can include a ground line, and is intended merely to indicate a line which carries a voltage which is desired for the operation of the circuit.

Preferably, a second storage capacitor is provided for storing the input voltage for driving the second drive transistor. This enables the data input time to be kept to a minimum.

The drive current provided by the second drive transistor is arranged to pass through the first drive transistor. The resulting gate-source voltage is then generated on the first storage capacitor.

Each pixel preferably further comprises an address transistor connected between a data input line and an input to the pixel.

Each pixel further preferably comprises a shorting transistor connected across the second storage capacitor. This can be used for discharging the second storage capacitor, to make sure the second drive transistor is turned off. Thus, once the pixel output is being generated by the first drive transistor, based on the stored gate-source voltage, the second drive transistor can be turned off. This reduces the duty cycle of operation of the second drive transistor, so that the effects of ageing can be minimised.

In one example, the first drive transistor is connected between a high power supply line and the anode of the display element, and the cathode of the display element is connected to a cathode line which is shared between a row of pixels. This defines a common cathode configuration, with the anode patterned for connection to the pixel circuitry.

In this case, a charging transistor can be connected between the high power supply line and the gate of the first drive transistor. This is used to turn on the first drive transistor and allow the gate-source voltage to vary to meet the current demand.

In another example, the anode of the display element is connected to a high power supply line which is shared between a row of pixels, the cathode of the display element is connected to the drain of the first drive transistor, and the source of the first drive transistor is connected to ground. This defines a so-called "structured cathode" configuration, and allows the first storage capacitor to be connected between the first drive transistor gate and ground (because the source of the first drive transistor is connected to ground).

In this case, the second drive transistor can be connected in series with a coupling transistor between a power supply line and the drain of the first drive transistor. This coupling transistor allows the second drive transistor current to be routed to the first drive transistor for the gate-source voltage sampling operation.

A charging transistor is preferably connected between ground and the gate of the first drive transistor, namely across the first storage capacitor. This can be used to switch off the first drive transistor, and provides a charging path for the second storage capacitor.

In all cases, threshold voltage compensation circuitry can be provided for providing threshold compensation of the second drive transistor. Although the duty cycle of the second drive transistor can be low to reduce ageing effects, it may in some cases be desirable to provide compensation for threshold voltage variations in the second drive transistor.

The compensation circuitry may comprise a third storage capacitor for storing the threshold voltage of the second drive transistor, wherein the second and third storage capacitors are in series, and wherein the input to the pixel is provided to the junction between the second and third storage capacitors. In this way, one capacitor holds the data input, and another holds the threshold voltage. The combination of voltages is provided across the gate-source junction of the second drive transistor.

Transistors are then provided in the pixel circuit to provide a charging path to enable the third storage capacitor to be charged to a voltage above the threshold voltage of the second drive transistor. The second drive transistor can then be driven by this voltage until the third storage capacitor voltage has been discharged to the threshold voltage.

The transistors may be implemented as amorphous silicon transistors.

The invention also provides a method of addressing an active matrix display device comprising an array of display pixels, in which each pixel comprises a current driven light emitting display element and a first drive transistor for driving a current through the display element, the method comprising, for each pixel:

using an input voltage to drive a second drive transistor, thereby generating a source drain current;

passing the source drain current through the first drive transistor;

storing the gate-source voltage of the first drive transistor resulting from passing the source drain current through the first drive transistor on a first storage capacitor;

driving the display element using the first drive transistor based on the stored gate-source voltage; and switching off the second drive transistor.

This provides voltage addressing, but with current sampling to compensate for threshold voltage variations in the first drive transistor.

Using an input voltage to drive the second drive transistor may comprise adding the input voltage to the threshold voltage of the second drive transistor and applying the result to the gate-source of the second drive transistor.

The invention will now be described by way of example with reference to the accompanying drawings, in which.

The same reference numerals are used in different figures for the same components, and description of these components will not be repeated. The description of the operation of the circuits also ignores any source-drain voltage drops across conducting TFTs for ease of explanation.

Figure 1:
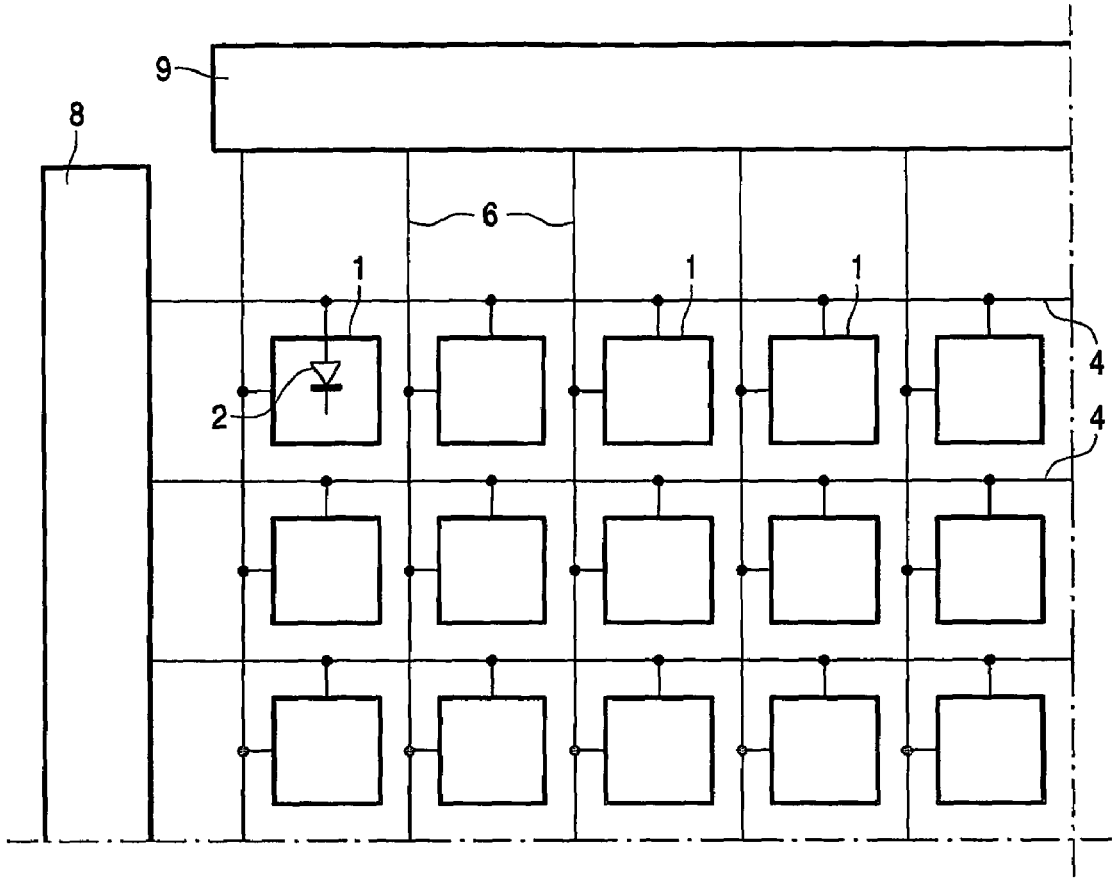
FIG.1 PRIOR ART
FIG. 1 shows a known EL display device.
Figure 2:
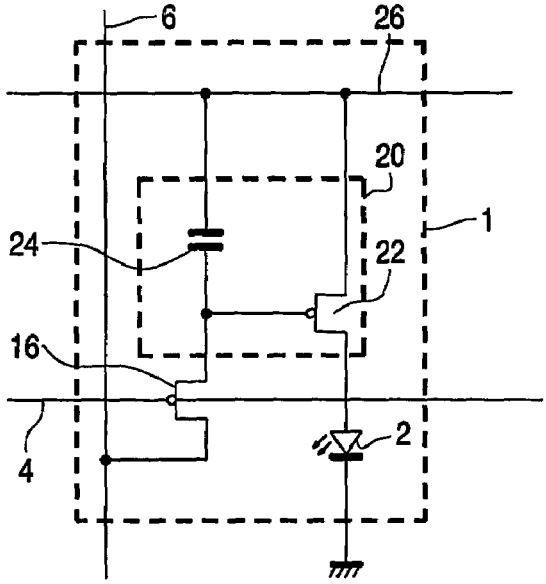
FIG.2 PRIOR ART
FIG. 2 is a simplified schematic diagram of a known pixel circuit using an input drive voltage.
Figure 3:
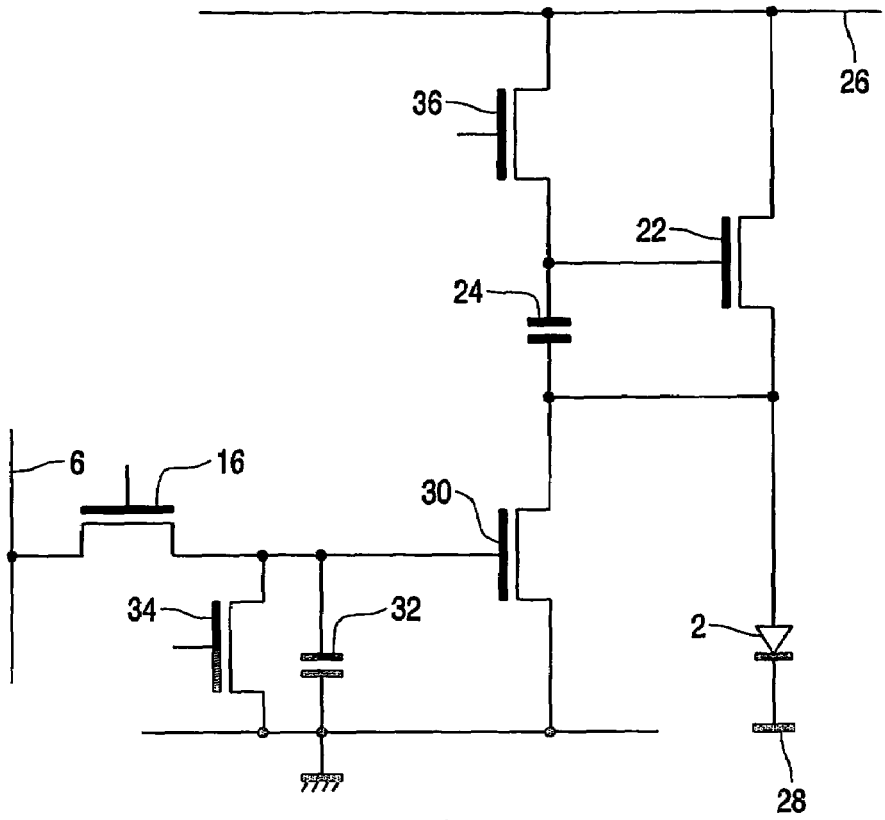
FIG. 3 shows a simplified schematic diagram of a first pixel layout for a display device of the invention.

FIG. 3 shows a first pixel arrangement in accordance with the invention. As in the conventional pixel of FIG. 2, the pixel is voltage-programmed, and a storage capacitor 24 stores the gate-source voltage of the drive transistor 22 after the pixel addressing (programming) phase. The circuit of FIG. 3 uses n-type transistors and is therefore suitable for implementation using amorphous silicon transistors.

In accordance with the invention, a second drive transistor 30 is provided for providing a drive current based on an input voltage provided to its gate. The address transistor 16 thus couples the input signal on data line 6 to the gate of the second drive transistor 30, which acts as a voltage driven current source.

The second drive transistor 30 is only operated during the pixel programming phase. During this phase, the current is passed through the first drive transistor 22 and the resulting gate-source voltage is sampled. The second drive transistor 30 can thus be operated with low duty cycle, so that the effects of ageing are minimised. In this way, the current output characteristics remain constant.

A second storage capacitor 32 is provided for storing the input voltage from the data line 6, and is connected between the gate of the second drive transistor 30 and ground. The addressing pulse (on transistor 16) therefore only needs to be sufficiently long to charge the second storage capacitor 32.

A shorting transistor 34 is connected across the second storage capacitor 32. This is used for discharging the second storage capacitor 32, to make sure the second drive transistor 30 is turned off after the programming phase has been completed.

A charging transistor 36 is connected between the high power supply line 26 and the gate of the first drive transistor 22. This is used to turn on the first drive transistor 22 and allow the gate-source voltage to vary to meet the current demand.

Only the drive transistor 22 is used in constant current mode. The transistors 16, 34 and 36 are used as switches that operate on a short duty cycle, and the transistor 30 acts as a current source but which is operated on a low duty cycle. Therefore, the threshold voltage drift in these devices is small and does not affect the circuit performance.

It will be apparent from the description below that the cathode 28 of the display element requires a switched voltage to be applied to it, and for this reason, separate cathode lines are required for each row of pixels in the array.

Figure 4:
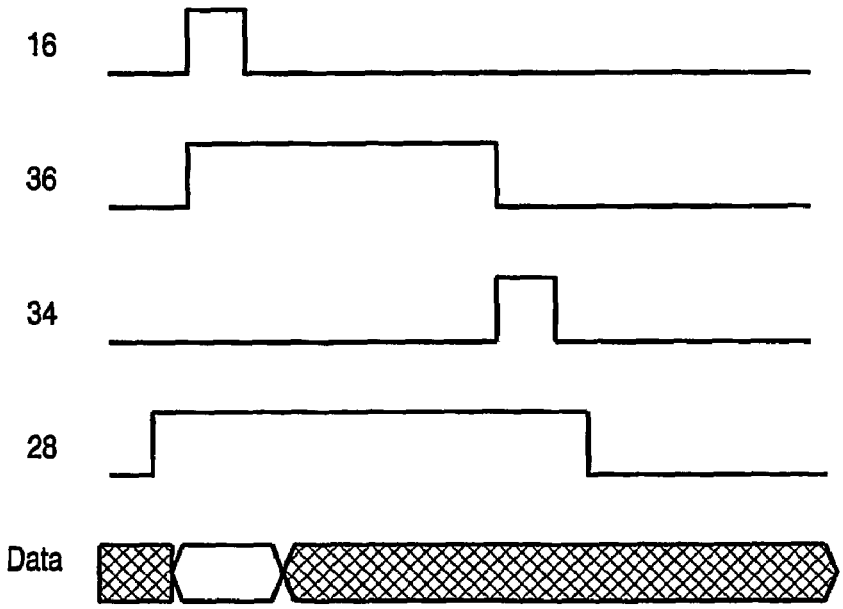
FIG. 4 is a timing diagram to explain the operation of the circuit of FIG. 3.

FIG. 4 is used to explain the operation of the circuit of FIG. 3. The plots 16, 36, 34 and 28 represent the gate voltages applied to the respective transistors. Plot "28" represents the voltage applied to cathode line 28, and the clear part of the plot "DATA" represents the timing of the data signal on the data line 6. The hatched area represents the time when data is not present on the data line 6. It will become apparent from the description below that data for other rows of pixels can be applied during this time so that data is almost continuously applied to the data line 6, giving a pipelined operation.

The pixel programming phase begins with a high pulse to turn on the address transistor 16. This allows a drive voltage for driving the second drive transistor 30 to be stored on the capacitor 32. At this time, the shorting transistor 34 is turned off to allow charge to be stored on the capacitor 32.

The charging transistor 36 is also turned on. This couples the gate and drain of the first drive transistor 22, which is thereby turned on, in a diode-connected configuration. During the programming phase, the cathode of the display element 2 is at a raised potential, so that the display element 2 is reverse biased. Thus, the current driven by the second drive transistor 30 is driven through the first drive transistor 22. The circuit stabilises when the gate-source voltage of the first drive transistor 22 corresponding to the current driven by the second drive transistor 30 is stored on the capacitor 24. The voltage on the source of the first drive transistor 22 is able to float to allow this equilibrium to be reached. Thus, the first drive transistor 22 is current-addressed and a voltage sampling operation is carried out.

The duration of the on-pulse for the charging transistor 36 is selected to allow the equilibrium to be reached. At the end of this on-pulse, the shorting transistor 34 is pulsed on to discharge the capacitor 32. This in turn ensures the second drive transistor 30 is turned off.

Finally, the cathode line is brought low, and current is driven through the display element by the first drive transistor.

The addressing sequence can be pipelined so that more than one row of pixels can be programmed at any one time. Thus, the addressing signals on lines 36, 24 and the row-wise cathode line 28 can overlap with the same signals for different rows. Thus, the length of the addressing sequence does not imply long pixel programming times, and the effective line time is only limited by the time required to charge the second capacitor 32 when the address line for the address transistor 16 is high. This time period is the same as for a standard active matrix addressing sequence. The other parts of the addressing mean that the overall frame time will only be lengthened slightly by the set-up required for the first few rows of the display. However this set can easily be done within the frame-blanking period so the time required for the threshold voltage measurement is not a problem.

Figure 5:
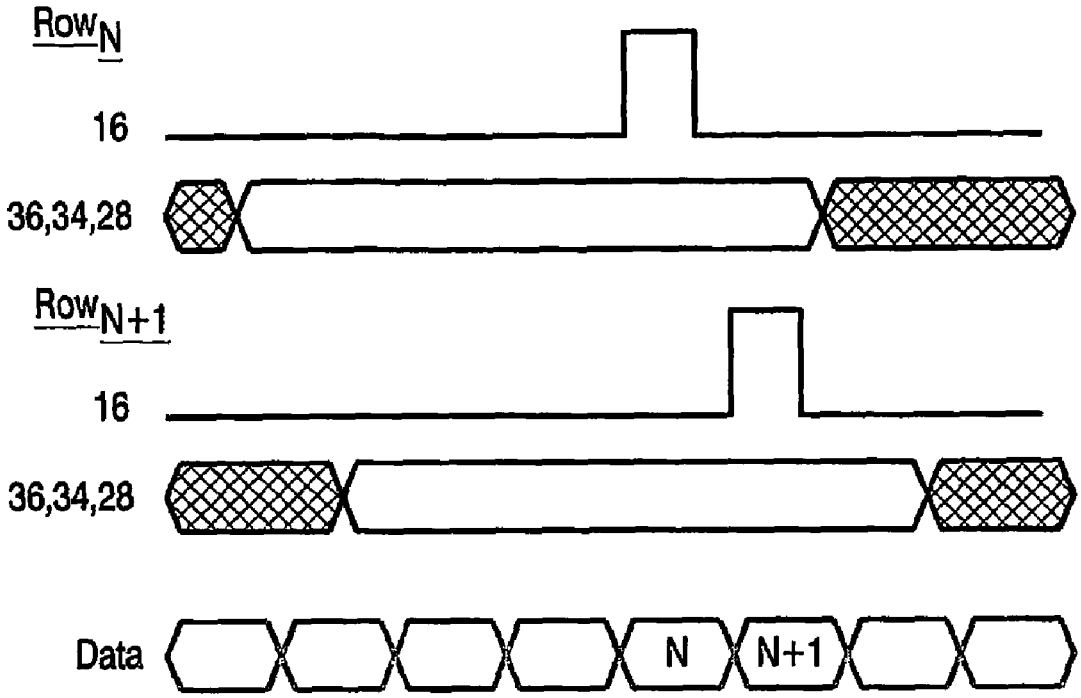
FIG. 5 is a timing diagram to explain further the operation of the circuit of FIG. 3.

Pipelined addressing is shown in the timing diagrams of FIG. 5. The control signals for the transistors 36 and 34 and the cathode line 28 have been combined into a single plot, but the operation is as described with reference to FIG. 4. The "Data" plot in FIG. 5 shows that the data line 6 is used almost continuously to provide data to successive rows.

In the example of FIG. 3, the first drive transistor is connected between a high power supply line and the anode of the display element, and the cathode of the display element is connected to a cathode line which is shared between a row of pixels. This defines a common cathode configuration, with the anode patterned for connection to the pixel circuitry.

In another example, the display element is inverted, so that the anode of the display element is connected to a high power supply line which is shared between a row of pixels, the cathode of the display element is connected to the drain of the first drive transistor, and the source of the first drive transistor is connected to ground. This defines a so-called "structured cathode" configuration, and allows the first storage capacitor to be connected between the first drive transistor gate and ground (because the source of the first drive transistor is connected to ground).

Figure 6:
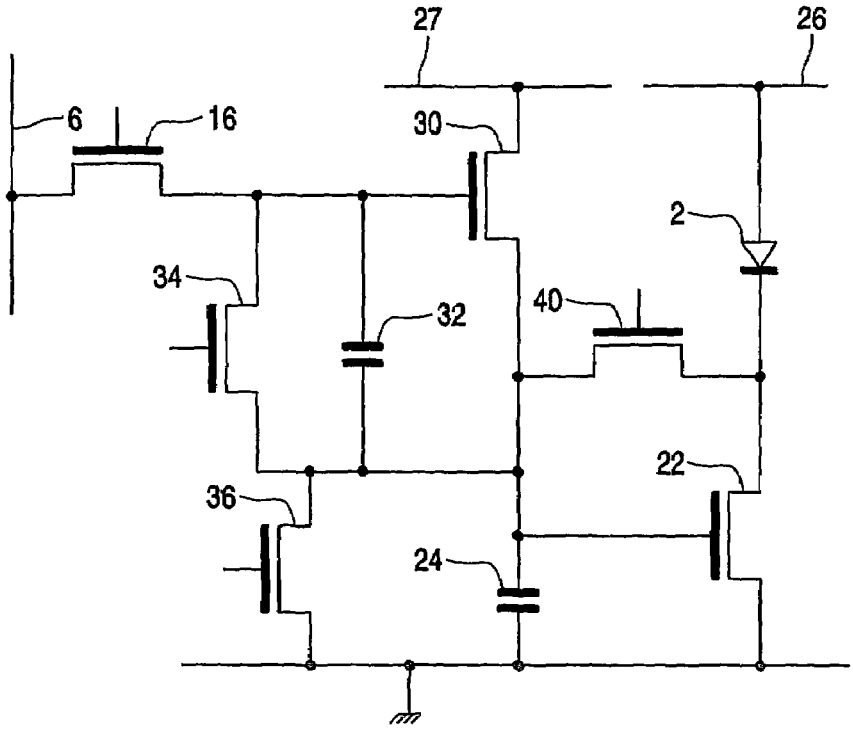
FIG. 6 shows a simplified schematic diagram of a second pixel layout for a display device of the invention.

An example of such a circuit is shown in FIG. 6. In this case, the second drive transistor 30 is connected between a second power supply line 27 and the gate of the first drive transistor 22. The second power supply line 27 is held permanently at the power supply voltage, whereas the first power supply line 26 has an alternative voltage waveform applied to it, as will be understood from the description below. A coupling transistor 40 is provided in series with the second drive transistor 30 between the power supply line 27 and the drain of the first drive transistor 22. This coupling transistor 40 provides a current path from the power supply line 27, through the second drive transistor 30 to the first drive transistor 22, and thus allows the second drive transistor current to be sampled by the first drive transistor.

The second storage capacitor is again connected between the gate and source of the second drive transistor 30, together with the parallel shorting transistor 34.

The charging transistor 36 is connected between ground and the gate of the first drive transistor 22, namely across the first storage capacitor 24. This can be used to switch off the first drive transistor 22 (by coupling its gate to ground), and provides a charging path for the second storage capacitor 32.

Figure 7:
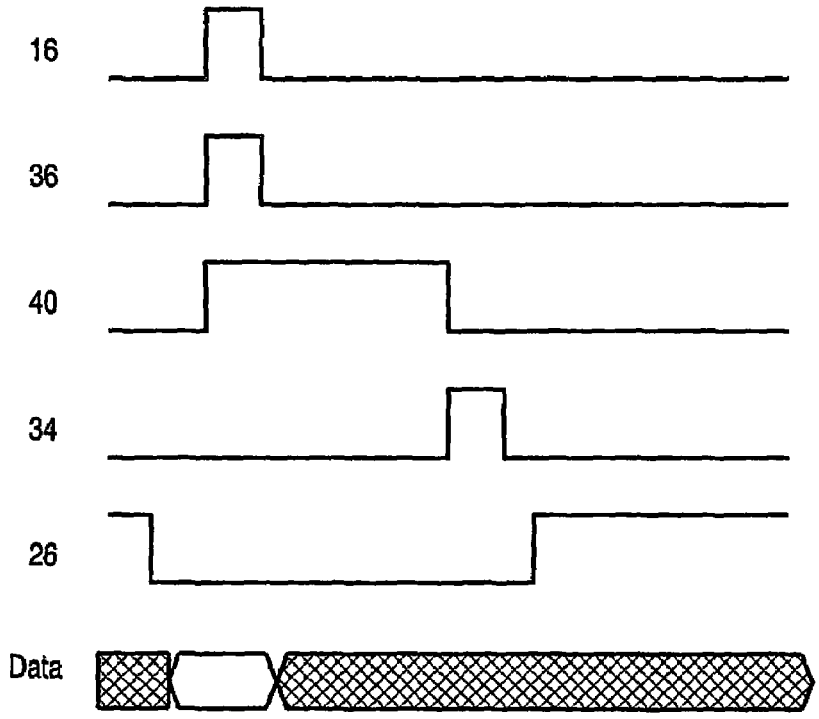
FIG. 7 is a timing diagram to explain the operation of the circuit of FIG. 6.

The operation of the circuit is shown in FIG. 7. During the initial address pulse for the transistor 16, the charging transistor 36 is also turned on so that the second storage capacitor can be charged to the input voltage. The first power supply line 26 has a low voltage applied to it during the programming phase so that the display element 2 is reverse biased and turned off.

The coupling transistor 40 is also turned on so that the current provided by the second drive transistor 30 from the second power supply line 27 passes to the first drive transistor 22, and the gate-source voltage of the first drive transistor 22 is sampled on the capacitor 24 in the same manner as described above. Whilst the charging transistor 36 is turned on, the first drive transistor 22 will be turned off, and the charging transistor 36 will also sink the current from the second drive transistor. The charging transistor 36 is turned off at the same time as the address transistor 16, and after it has been turned off, the stabilisation of the gate source voltage of the first drive transistor 22 can begin.

Again, at the end of the sampling operation, a pulse on the shorting transistor 34 discharges the second storage capacitor to turn off the second drive transistor, and the first power supply line 26 is brought high to drive the display element at the end of the programming phase.

Pipelined addressing can again be carried out in similar manner to that explained with reference to FIG. 5.

The circuits above rely on the low duty cycle of the second drive transistor 30 to avoid the need for any ageing compensation circuitry. However, threshold voltage compensation circuitry can be provided for providing threshold compensation of the second drive transistor. It may in some cases be desirable to provide compensation for threshold voltage variations in the second drive transistor.

Figure 8:
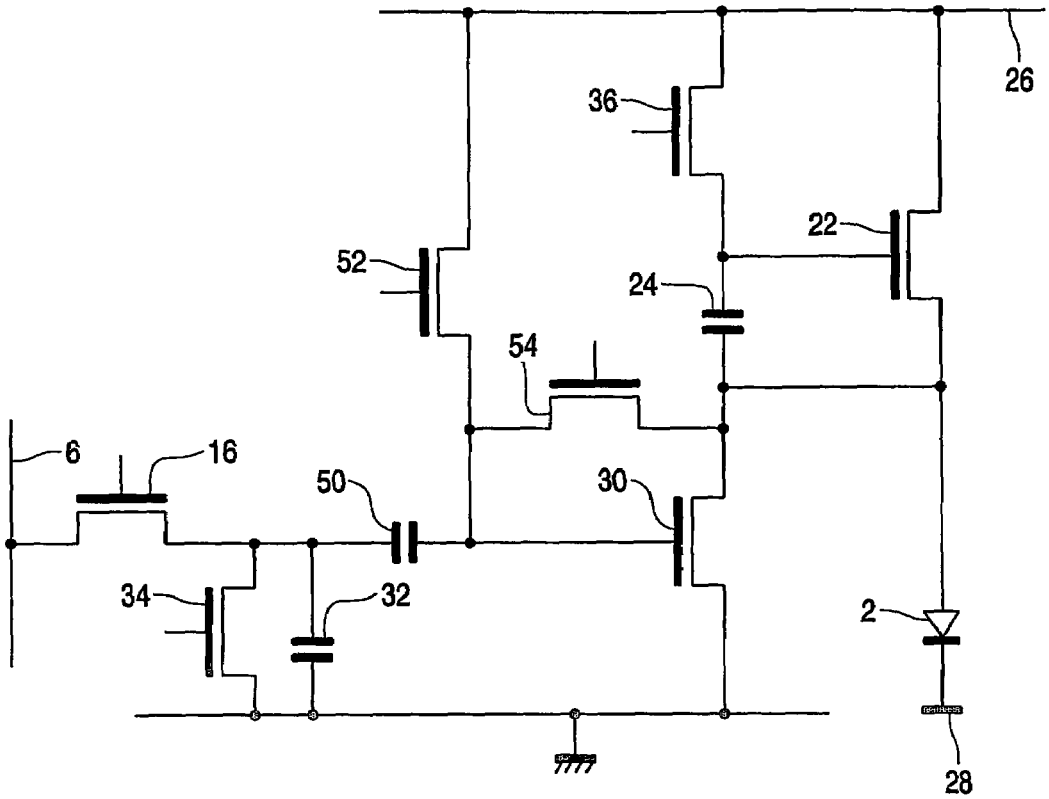
FIG. 8 shows a simplified schematic diagram of a third pixel layout for a display device of the invention.

FIG. 8 shows a modification to the circuit of FIG. 3, in which a third storage capacitor 50 is provided for storing the threshold voltage of the second drive transistor 30. The second and third storage capacitors 32, 50 are in series between the gate and source of the second drive transistor 30, and the input to the pixel is provided to the junction between them. The circuit is operated to provide the data input on the second storage capacitor 32 and the threshold voltage on the third capacitor 50. The combination of voltages is provided across the gate-source junction of the second drive transistor and the transistor is in this way driven to a desired voltage over the threshold.

A charging path is provided to enable the third storage capacitor 50 to be charged to a voltage above the threshold voltage of the second drive transistor. Transistor 52 is provided for this purpose between the power supply line 26 and the gate of the second drive transistor 30. A further transistor 54 is also required, between the gate and drain of the second drive transistor 30, as will become apparent from the following description of the operation of the circuit with reference to FIG. 9.

Figure 9:
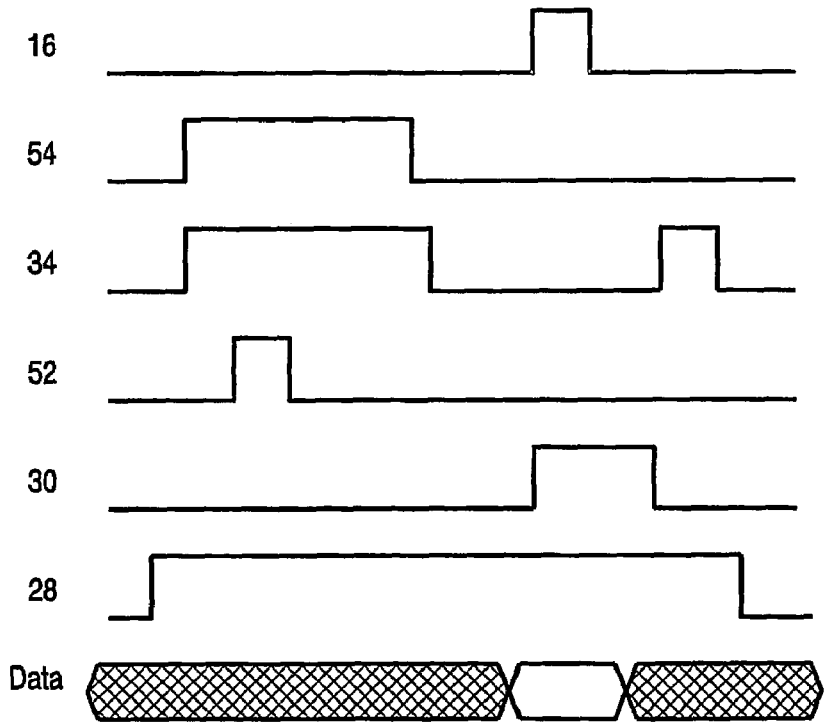
FIG. 9 is a timing diagram to explain the operation of the circuit of FIG. 8.

The programming phase has an initial period when the threshold voltage of the second drive transistor is stored on the third capacitor. As shown in FIG. 9, the shorting transistor 34 and the transistor 54 are initially turned on. This diode-connects the second drive transistor 30 and shorts out the capacitor 32.

The transistor 52 is then turned on. This drives a current through the second drive transistor 30 (its drain being at the power supply line voltage through the transistors 52, 54). In addition, the capacitor 50 is charged to the power supply line voltage, which of course exceeds the threshold voltage of the drive transistor. A relatively short pulse is provided for the transistor 52 and the voltage is then stored on the capacitor 50. After the transistor 52 is turned off, the second drive transistor remains conducting, and the source-drain current discharges the capacitor 50. The second drive transistor turns off when the capacitor 50 stores only the threshold voltage.

Thus, immediately before the address pulse for the address transistor 16, the threshold voltage is stored on capacitor 50. With transistors 34 and 54 turned off, an input voltage can be used to charge the second storage capacitor 32. The resulting voltage on the gate of the second drive transistor 30 compensates for the threshold voltage, and the current is driven through the first drive transistor 22, which is turned on by the connection of its gate and drain by transistor 36. The gate-source voltage is again stored on capacitor 24.

As above, the second pulse for transistor 34 ensures the second drive transistor 30 is turned off, and the cathode line 28 is then switched low to operate the display element.

Figure 10:
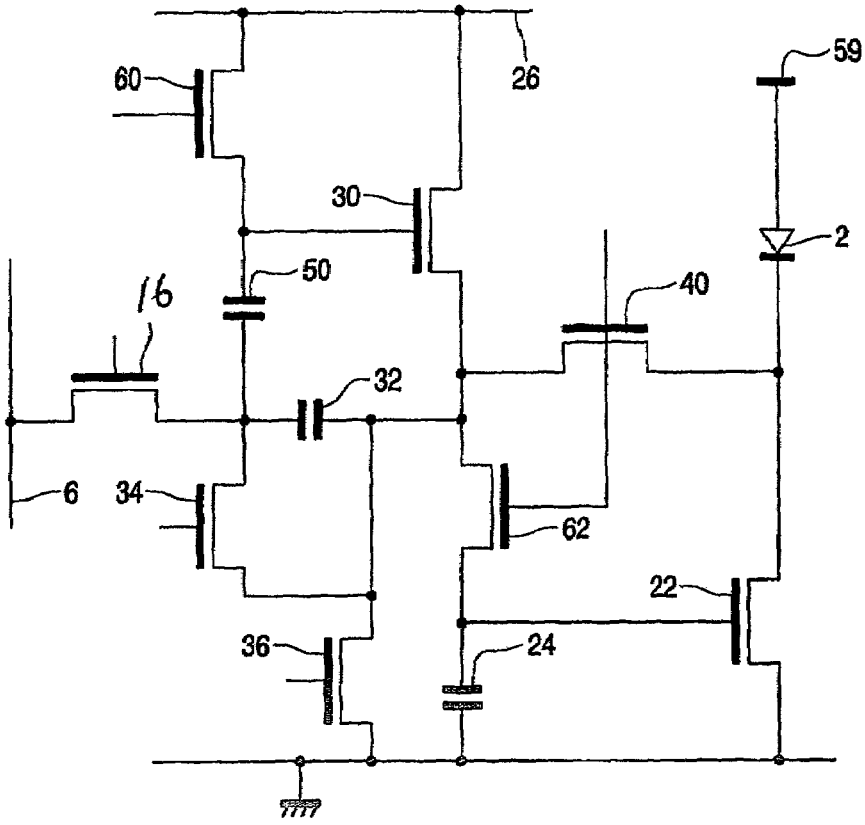
FIG. 10 shows a simplified schematic diagram of a fourth pixel layout for a display device of the invention.

FIG. 10 shows a modification to the circuit of FIG. 6, again in which a third storage capacitor 50 is provided for storing the threshold voltage of the second drive transistor 30. A separate power supply line (anode line 59) is required for each row of pixels, as will become apparent from the following. The second and third storage capacitors 32, 50 are again in series between the gate and source of the second drive transistor 30, and the input to the pixel is provided to the junction between them.

The circuit is again operated to provide the data input on the second storage capacitor 32 and the threshold voltage on the third capacitor 50. Transistor 60 is provided to provide the charging path to enable the third storage capacitor 50 to be charged to a voltage above the threshold voltage of the second drive transistor. Transistor 60 is between the power supply line 26 and the gate of the second drive transistor 30.

Figure 11:
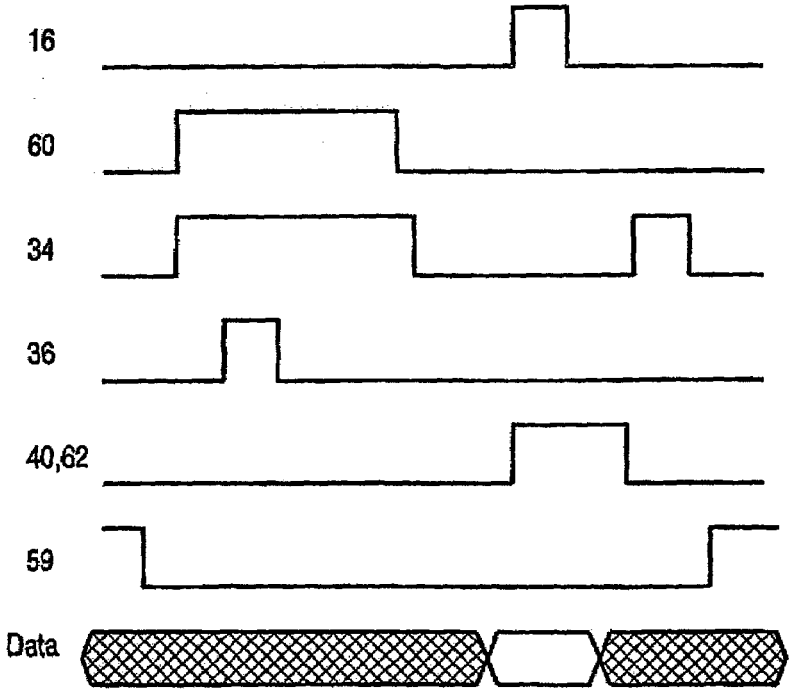
FIG. 11 is a timing diagram to explain the operation of the circuit of FIG. 10.

A further transistor 62 is again required. The operation of the circuit is described with reference to FIG. 11.

During the initial period, when the threshold voltage of the second drive transistor is stored on the third capacitor, the shorting transistor 34 and the transistor 60 are initially turned on. This diode-connects the second drive transistor 30 and shorts out the capacitor 32.

The transistor 36 is then turned on. This drives a current through the second drive transistor 30. In addition, the capacitor 50 is charged to the power supply line voltage through transistors 60, 34 and 36. A relatively short pulse is provided for the transistor 36 and the voltage is then stored on the capacitor 50. After the transistor 36 is turned off, the second drive transistor 30 remains conducting, and the source-drain current discharges the capacitor 50. The second drive transistor turns off when the capacitor 50 stores only the threshold voltage.

Thus, immediately before the address pulse for the address transistor 16, the threshold voltage is stored on capacitor 50. Transistors 34 and 60 are turned off.

During the addressing pulse, an input voltage is used to charge the second storage capacitor 32, which is connected to ground through the transistor 40 and the drive transistor 22, which are now turned on. Once the voltage on the capacitor 32 is stable, the only current flowing to the first drive transistor 22 is from the second drive transistor 30 (through transistor 40). The first drive transistor 22 is turned on by the connection of its gate and drain by transistor 62. The gate-source voltage is again stored on capacitor 24.

As above, the second pulse for transistor 34 ensures the second drive transistor 30 is turned off, and the anode line 58 is then switched high to operate the display element.

The transistors in the circuits may be implemented as amorphous silicon transistors, and the circuit operates to compensate for the ageing of these transistors. For this reason, the circuits above have been shown implemented with only n-type transistors. Although the fabrication of n-type devices is preferred in amorphous silicon, alternative circuits could of course be implemented with p-type devices or combinations.

The display devices may be polymer LED devices, organic LED devices, phosphor containing materials and other light emitting structures. In particular, the invention enables the use of a-Si:H for active matrix OLED displays.

The invention has been illustrated with a number of example circuits. However, the invention is not limited to these examples only, and provides more generally an addressing scheme by which an input voltage is used to generating a desired source-drain current using a transistor operated with low duty cycle. This source drain current is then sunk through a drive transistor and the resulting gate-source voltage is stored for subsequent driving of the display element.

Various other modifications will be apparent to those skilled in the art.

The invention claimed is:

1. An active matrix display device comprising an array of display pixels, each pixel comprising:

a current driven light emitting display element and a first drive transistor for driving a current through the display element, the display element and the first drive transistor being in series between power supply lines;

a first storage capacitor for storing a gate-source voltage of the first drive transistor;

a second drive transistor, operable only during pixel programming, for providing a drive current based on an input I voltage provided to a gate of the second drive transistor; and a second storage capacitor for storing the input voltage for driving the second drive transistor, wherein the second storage capacitor is connected between the gate and a drain of the second drive transistor;

wherein the drive current provided by the second drive transistor passes through the first drive transistor, a voltage thereby being generated on the first storage capacitor corresponding to the drive current.

2. The device as claimed in claim 1, wherein each pixel further comprises an address transistor connected between a data input line and an input to the pixel.

3. The device as claimed in claim 1, wherein the current driven light emitting display element comprises an electroluminescent display element.

4. An active matrix display device comprising an array of display pixels, each pixel comprising:

a current driven light emitting display element and a first drive transistor for driving a current through the display element, the display element and the first drive transistor being in series between power supply lines;

a first storage capacitor for storing a gate-source voltage of the first drive transistor;

a second drive transistor for providing a drive current based on an input voltage provided to a gate of the second drive transistor; and a second storage capacitor for storing the input voltage for driving the second drive transistor;

wherein each pixel further comprises a shorting transistor connected across the second storage capacitor.

5. An active matrix display device comprising an array of display pixels, each pixel comprising:

a current driven light emitting display element and a first drive transistor for driving a current through the display element, the display element and the first drive transistor being in series between power supply lines;

a first storage capacitor for storing a gate-source voltage of the first drive transistor;

a second drive transistor for providing a drive current based on an input voltage provided to a gate of the second drive transistor; and a second storage capacitor for storing the input voltage for driving the second drive transistor;

wherein the first drive transistor is connected between a high power supply line and the anode of the display element, and the cathode of the display element is connected to a cathode line which is shared between a row of pixels.

6. The device as claimed in claim 5, wherein a charging transistor is connected between the high power supply line and the gate of the first drive transistor.

7. An active matrix display device comprising an array of display pixels, each pixel comprising:

a current driven light emitting display element and a first drive transistor for driving a current through the display element, the display element and the first drive transistor being in series between power supply lines;

a first storage capacitor for storing a gate-source voltage of the first drive transistor;

a second drive transistor for providing a drive current based on an input voltage provided to a gate of the second drive transistor; and a second storage capacitor for storing the input voltage for driving the second drive transistor;

wherein the anode of the display element is connected to a high power supply line which is shared between a row of pixels, the cathode of the display element is connected to the drain of the first drive transistor, and the source of the first drive transistor is connected to ground.

8. The device as claimed in claim 7, wherein the second drive transistor is connected in series with a coupling transistor between a power supply line and the drain of the first drive transistor.

9. The device as claimed in claim 8, wherein a charging transistor is connected between ground and the gate of the first drive transistor.

10. An active matrix display device comprising an array of display pixels, each pixel comprising:

a current driven light emitting display element and a first drive transistor for driving a current through the display element, the display element and the first drive transistor being in series between power supply lines;

a first storage capacitor for storing a gate-source voltage of the first drive transistor;

a second drive transistor for providing a drive current based on an input voltage provided to a gate of the second drive transistor;

a second storage capacitor for storing the input voltage for driving the second drive transistor; and a voltage compensation circuitry for providing threshold compensation of the second drive transistor, the compensation circuitry including a third storage capacitor for storing the threshold voltage of the second drive transistor, and transistors to provide a charging path to enable the third storage capacitor to be charged to a voltage above the threshold voltage of the second drive transistor.

11. The device as claimed in claim 10, wherein the second and third storage capacitors are in series, and wherein the input to the pixel is provided to the junction between the second and third storage capacitors.

12. A method of addressing an active matrix display device comprising an array of display pixels, in which each pixel comprises a current driven light emitting display element and a first drive transistor for driving a current through the display element, the method comprising, for each pixel:

using an input voltage to drive a second drive transistor, thereby generating a source drain current;

passing the source drain current through the first drive transistor;

storing the gate-source voltage of the first drive transistor resulting from passing the source drain current through the first drive transistor on a first storage capacitor;

driving the display element using the first drive transistor based on the stored gate-source voltage; and switching off the second drive transistor; wherein using an input voltage to drive the second drive transistor comprises adding the input voltage to the threshold voltage of the second drive transistor and applying the result to the gate-source of the second drive transistor.

13. A method of addressing an active matrix display device comprising an array of display pixels, in which each pixel comprises a current driven light emitting display element and a first drive transistor for driving a current through the display element, the method comprising, for each pixel:

using an input voltage to drive a second drive transistor, thereby generating a source drain current;

passing the source drain current through the first drive transistor;

storing the gate-source voltage of the first drive transistor resulting from passing the source drain current through the first drive transistor on a storage capacitor;

driving the display element using the first drive transistor based on the stored gate-source voltage; and once the display element is driven using the first drive transistor, switching off the second drive transistor so that the second drive transistor is driven with a reduced duty cycle for long enough for the gate-source voltage be stored on the storage capacitor.

* * * * *